US007779578B2

(12) United States Patent
Gray

(10) Patent No.: US 7,779,578 B2
(45) Date of Patent: Aug. 24, 2010

(54) ROLLING DOOR RETAINER

(76) Inventor: Bill M. Gray, 542 Ranger La., Longboat Key, FL (US) 34228

( * ) Notice: Subject to any disclaimer, the term of this patent is extended or adjusted under 35 U.S.C. 154(b) by 0 days.

(21) Appl. No.: 12/195,757

(22) Filed: Aug. 21, 2008

(65) Prior Publication Data

US 2009/0013608 A1 Jan. 15, 2009

Related U.S. Application Data

(63) Continuation of application No. 11/079,700, filed on Mar. 14, 2005, now abandoned.

(51) Int. Cl.
*E06B 3/00* (2006.01)

(52) U.S. Cl. ..... 49/506; 49/409; 49/410; 49/425

(58) Field of Classification Search ..... 49/103, 49/116, 118, 120, 125, 409, 410, 411, 425, 49/404, 370, 506; 4/557, 607; 16/91, 87.6 R, 16/87.6 W, 87.8, 90, 99, 105, 106
See application file for complete search history.

(56) References Cited

U.S. PATENT DOCUMENTS

| | | | | | |
|---|---|---|---|---|---|
| 1,485,200 | A | * | 2/1924 | Roberts | 49/409 |
| 2,937,416 | A | | 5/1960 | Hiers | |
| 2,950,756 | A | | 8/1960 | Treanor | |
| 3,282,618 | A | | 11/1966 | Adickes | |
| 3,714,738 | A | | 2/1973 | Koslow et al. | |
| 3,975,041 | A | | 8/1976 | Edison | |
| 4,054,308 | A | | 10/1977 | Prohaska | |
| 4,281,477 | A | * | 8/1981 | Kaminaga | 49/453 |
| 4,593,499 | A | * | 6/1986 | Kobayashi et al. | 52/126.6 |
| 4,630,853 | A | | 12/1986 | Bell et al. | |
| 4,850,145 | A | | 7/1989 | McAfee | |
| 4,854,078 | A | * | 8/1989 | DePrima | 49/409 |
| 4,881,346 | A | * | 11/1989 | Block | 49/501 |
| 4,881,768 | A | * | 11/1989 | Lange | 292/251 |
| 5,123,128 | A | * | 6/1992 | Hines | 4/557 |
| 5,170,831 | A | | 12/1992 | Bilt | |
| 5,351,442 | A | | 10/1994 | Gingras et al. | |
| 5,598,666 | A | * | 2/1997 | Kurth | 49/409 |
| 5,724,770 | A | | 3/1998 | McAfee | |
| 5,742,979 | A | | 4/1998 | Garcia-Hernando et al. | |
| 6,115,968 | A | * | 9/2000 | Sarlanis | 49/409 |
| 6,360,492 | B1 | | 3/2002 | Ross | |
| 6,381,904 | B1 | | 5/2002 | Tedescucci | |
| 6,442,900 | B1 | * | 9/2002 | Kvasnes | 49/409 |
| 6,497,072 | B2 | | 12/2002 | Fries et al. | |
| 6,584,664 | B2 | | 7/2003 | Hostetler et al. | |
| 7,021,007 | B2 | | 4/2006 | Jacobs et al. | |
| 2001/0054258 | A1 | * | 12/2001 | Becken | 49/409 |
| 2002/0066228 | A1 | | 6/2002 | Janutta et al. | |
| 2005/0246962 | A1 | | 11/2005 | Jacobs | |
| 2007/0017157 | A1 | | 1/2007 | Ambrozus | |

* cited by examiner

*Primary Examiner*—Katherine W Mitchell
*Assistant Examiner*—Catherine A Kelly
(74) *Attorney, Agent, or Firm*—Gifford, Krass, Sprinkle, Anderson & Citkowski, P.C.

(57) ABSTRACT

A retainer for aircraft hangar doors in which vertical movement of doors is adjustably limited to allow sufficient movement to permit door removal from their supporting tracks or to prevent such undesirable displacement during high wind conditions as experienced during hurricanes and tornadoes or violent earth motions during earthquakes. The retainer in its retaining position does not obstruct normal opening and closing of the doors and is economical to manufacture and install.

9 Claims, 3 Drawing Sheets

ROLLING DOOR RETAINER

CROSS-REFERENCE TO RELATED APPLICATIONS

This application is a continuation of U.S. patent application Ser. No. 11/079,700 filed on Mar. 14, 2005, now abandoned.

FIELD OF THE INVENTION

This invention relates to retainers for rolling doors and in particular to rolling doors for aircraft hangars in which relatively wide openings are closed by multiple doors arranged at opposite sides of the door opening to be stacked in a door open position at one side of the opening and to slightly overlap each other in a door closed position.

BACKGROUND OF THE INVENTION

Sliding or rolling doors and windows are commonly used in household and commercial buildings usually with a pair of doors closing an enclosure. Such doors typically have their own upper and lower guide tracks and are removable by vertical movement upwardly a small amount into the upper guide track to dislodge the lower portion of the door and permit its removal. Various devices have been developed to prevent such movement but their installation and use require the sides of guiding tracks or doors to be exposed. Also, such devices often prevent all movement of the doors which prevents their normal use. With aircraft hangar doors the door opening is very wide and multiple doors are used at each side of the door opening which obstruct the access to the upper track and upper door portions that are required to mace the prior art installation.

Aircraft doors of the rolling type typically are of light structure with a perimeter formed of channel members on the skin of light metal on one or both sides. The lower perimeter of the door typically supports track-engaging rollers which support the weight of the door during rolling and sliding movement between open and closed positions. The upper perimeter member of the door also supports rollers on vertical axis which engage the inside surfaces of flange members of a channel shaped guide member and hold the door in vertical position. Such doors are moveable vertically upwardly into the upper guide channel to permit placement of the lower track engaging rollers on the guide track. It is this characteristic of sliding doors to which the invention is directed.

SUMMARY OF THE INVENTION

Hurricanes and high winds are known to cause such doors to be lifted off of the tracks and to fall against expensive aircraft causing much damage. Violent earth motion during earthquakes can cause the same phenomenon.

Examination of aircraft hangars damaged following hurricanes that impacted Florida in 2004 found that a principal damage to aircraft in hangars was caused by the doors of the hangars which high winds caused to be displaced from their intended position and crash against the airplane housed in the hangar.

It would be very desirable to provide a means for preventing door displacement from their guiding tracks unless needed for door replacement and repair. Therefore, it is an object of the invention to provide a door retainer which prevents vertical displacement of the door and its rollers from its supporting track and at the same time permits the doors to be used without interference.

It is another object of the invention to provide such a door retainer which is easily installed on existing doors when they are in position on their tracks.

It is an object of the invention to provide a door retainer which prevents vertical displacement of the door and its rollers from the supporting track.

These and other objects of the invention are attained by a door retainer for aircraft hangar doors in which vertical movement of the door rollers to raise them off of their supporting tracks is prevented by a vertical retainer bolt adjustable to project above the upper top edge of the doors to engage the top guiding channel of the doors to limit upward door movement that might otherwise occur in strong or high wind conditions or during earthquakes. Such adjustment does not hinder normal opening and closing of the doors. The door retaining bolts are adjustable to a retracted position to permit door removal or replacement when required.

DETAILED DESCRIPTION OF THE PREFERRED EMBODIMENTS

Figure 1:
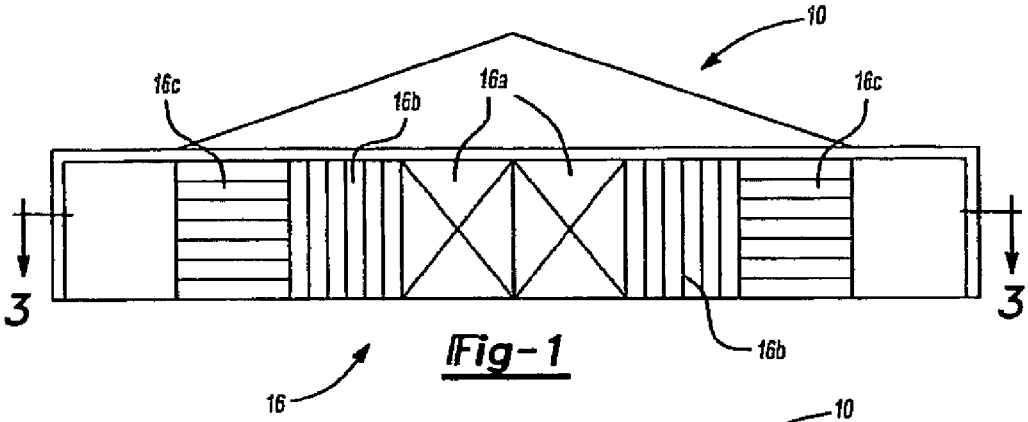
FIG. 1 is an elevation of an airplane hangar with multiple doors of the type to which the present invention is directed shown with the doors in their closed position.
Figure 2:
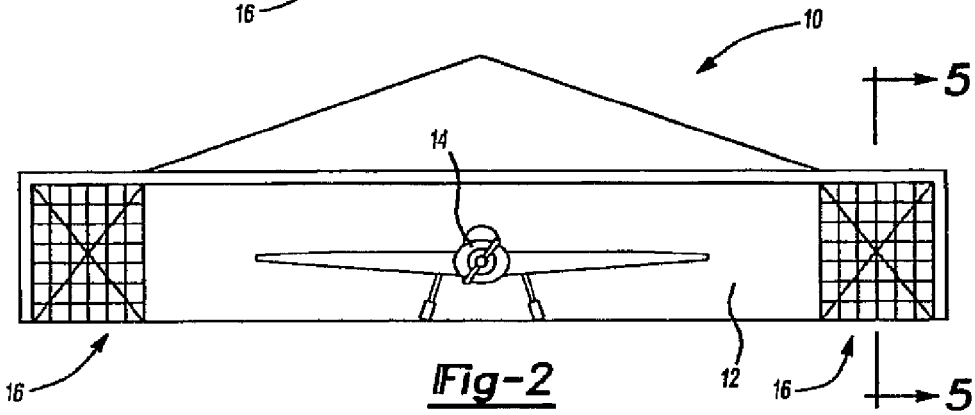
FIG. 2 is an elevation similar to FIG. 1 in which the doors are in an open position.
Figure 3:
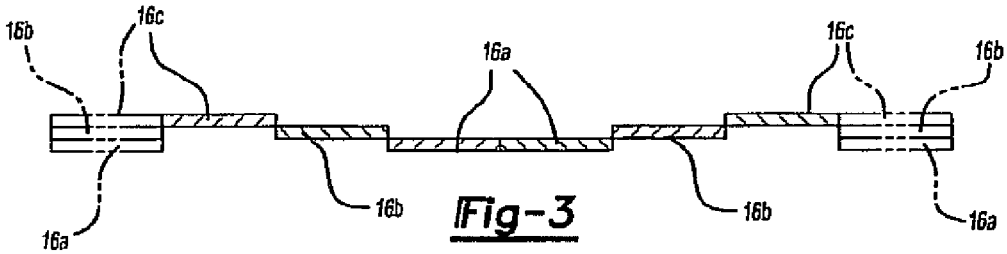
FIG. 3 is a diagrammatic sectional view generally on line 3-3 in FIG. 1 showing the doors in their closed position.

The rolling doors to which the retainer of the present invention are related are shown in FIGS. 1 through 3. There are a wide variety of rolling and sliding doors and windows in use but those used for aircraft hangars such as designated at 10 must cover wide openings 12 to accommodate large wing spans of airplanes 14. Consequently, they are used in larger numbers of four, six, eight or more to cover the hangar wide door opening. The present description will make reference to three doors at each side of an opening for a total of six doors.

Figure 4:
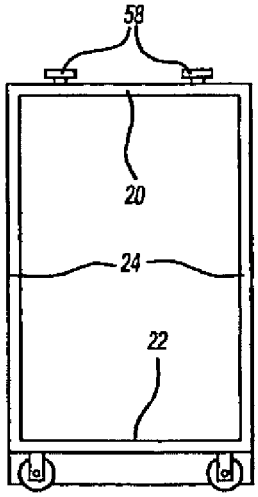
FIG. 4 is an elevation of one door separated from the upper guiding tracks.
Figure 5:
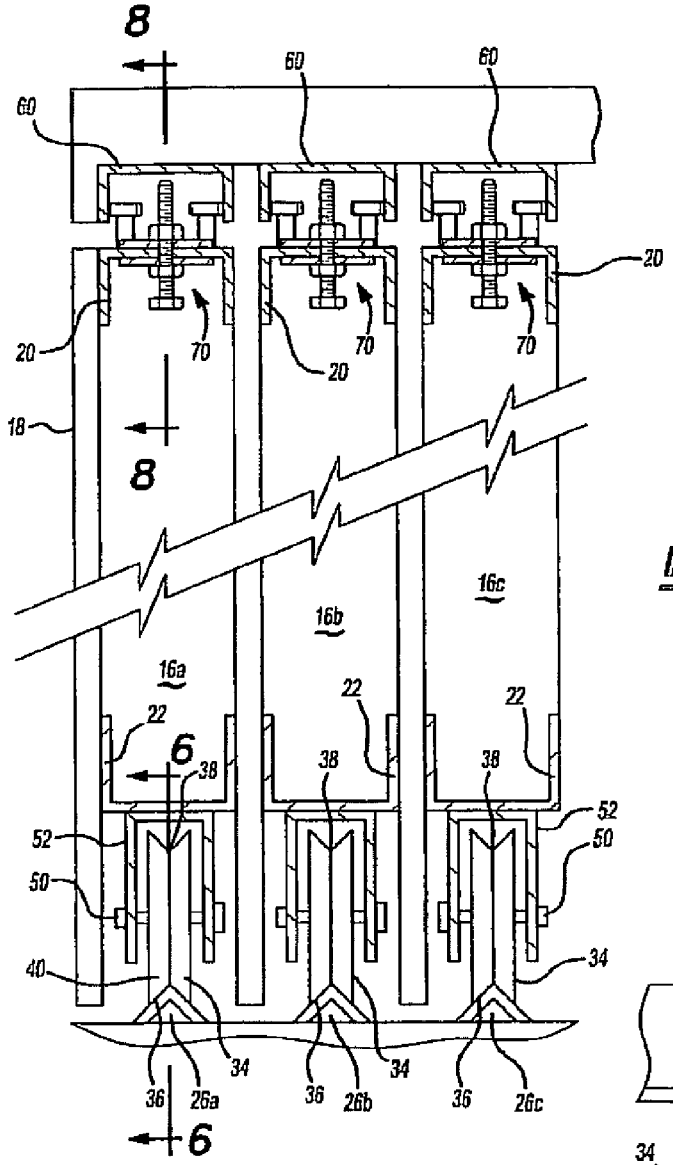
FIG. 5 is a cross-sectional view of three doors in their stacked condition as shown along line 5-5 in FIG. 2.

Such doors are designated generally at 16 and typically are fabricated of light metal channel members defining the perimeter of the door and which can best be seen in FIG. 5 with at least one side of the doorframe being covered with a light metal panel 18 often of a corrugated configuration. Each door typically has an upper channel member 20, a lower horizontal frame member 22 and opposed vertically disposed door edge members 24 as seen diagrammatically in FIG. 4.

As best seen in FIGS. 1-3 and 5, with a six door arrangement having three doors disposed at each side of the door opening 12 a pair of central doors 16*a* are disposed to roll on a track 26*a*. A pair of intermediate doors 16*b* are disposed adjacent each of the central doors 16*a* and are disposed to roll on tracks 26*b*. Similarly a pair of end doors 16*c* are disposed to roll on tracks 26*c* and are adjacent to the intermediate door 16*b*.

The tracks 26*a*, 26*b* and 26*c* are parallel to each other and each support a pair of doors 16*a*, 16*b* and 16*c*, respectively, for movement at opposite sides of the door opening 12. Such tracks extend beyond the sides of the door opening 12 to provide storage space for the doors in their open position as indicated at FIG. 2.

In FIGS. 1 and 2 the doors 16 are disposed on the outside of the hangar 10 with storage of the stacked open doors extending beyond the sides of the building. Alternatively, however, where space permits, such doors are often mounted on the inside of the building so the stacked open doors 16 are within the interior of the hangar.

Figure 6:
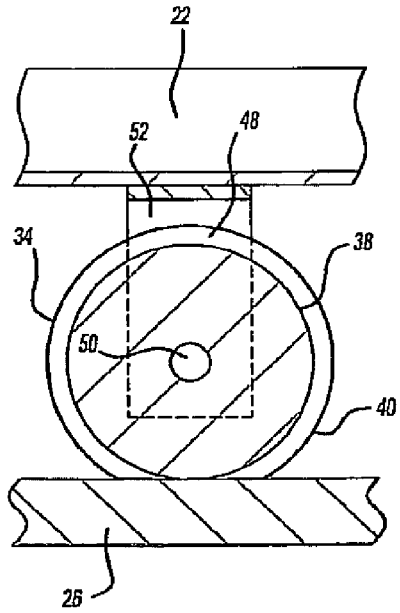
FIG. 6 is a cross sectional view of one of the door rollers taken on line 6-6 in FIG. 5.
Figure 7:
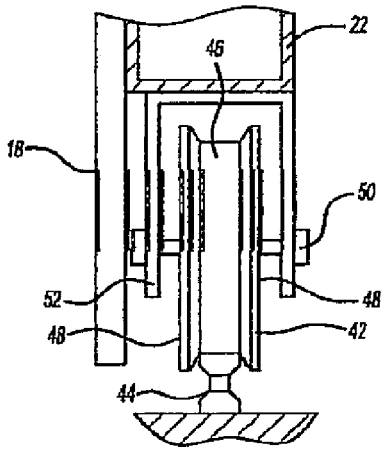
FIG. 7 is a view of an alternative form of roller used with doors of the type related to this invention.

As best seen in FIGS. 5-6, the bottom frame member 22 of each of the doors 16*a*, 16*b* and 16*c* are provided with rollers or wheels 34 which roll on tracks 26*a*, 26*b* and 26*c*. The rollers 34 seen in FIG. 5 are formed with a V groove 36 which are complementary to the tracks 26*a*, 26*b* and 26*c*. Such tracks typically are fabricated of ninety-degree angle iron which is readily available. The rollers 34 as seen in FIG. 5 have a central track engaging portion 38 and opposed cheeks 40. The cheeks 40 are larger radius than the central portion 38 to maintain the doors on their track. Because of the shape of the tracks, the V shaped wheels have a tendency to be cammed off the tracks when lateral pressure such as that due to high winds or earthquakes is applied to the doors. As an alternative to the V shaped rollers those of the type seen in FIGS. 6 and 7 are used. Such rollers 42 are intended to engage conventional rail type tracks 44. The rollers 42 have a central track engaging portion 46 and a larger diameter opposed cheeks 48 to maintain the rollers on the track 44.

Whether the rollers 34 or 42 or employed both are supported on axles 50 which are held in position on the doors 16*a*, 16*b* and 16*c* by a U shaped bracket member 52 which can be bolted or otherwise fastened to the bottom channel member 22 of each of the doors. Preferably, a roller is attached adjacent to each of the opposite edges of each of the doors.

Figure 8:
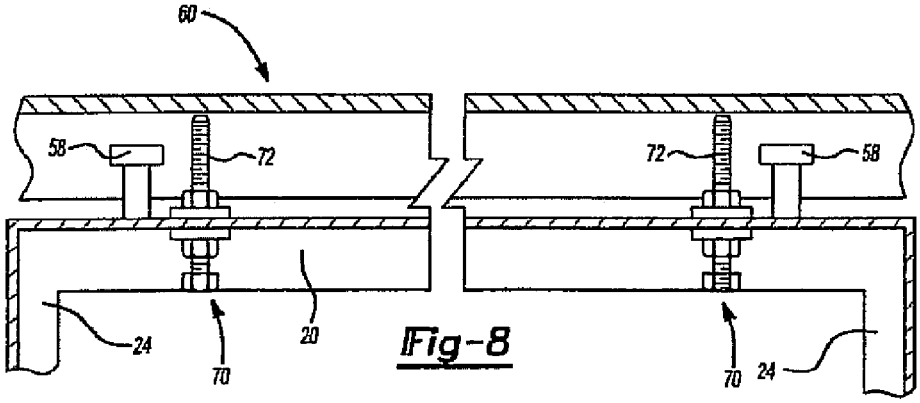
FIG. 8 is a cross sectional view of the upper end of one of the doors on line 8-8 in FIG. 5.
Figure 9:
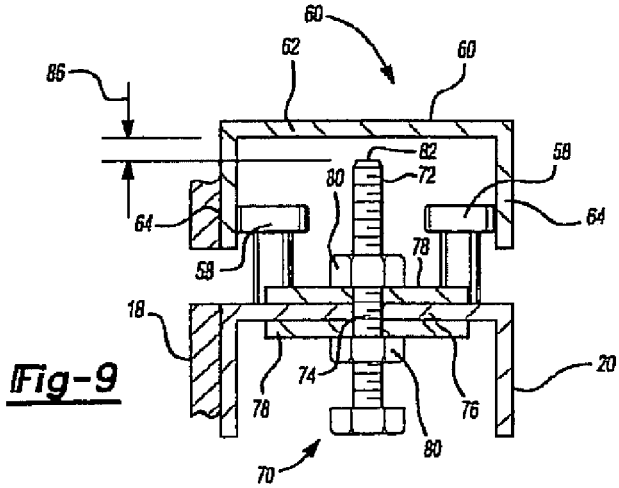
FIG. 9 is an enlarged view of the retainer of the invention shown in cross section.

As best seen in FIGS. 8 and 9, the doors 16*a*, 16*b* and 16*c* are maintained in a vertical position by means of guide rollers 58 arranged at the upper edge of each of the doors for engagement with a guide track 60. The guide track 60 is an inverted channel member having a central web 62 with opposed depending flanges 64. A separate guide track 60 is used for each of the pairs of doors and each of the tracks 26*a*, 26*b* and 26*c*. The upper tracks 60 extend continuously across the opening 12 in the hangar 10 and often extend beyond the opposite edges of the building as seen in FIGS. 1 and 2.

The guide rollers 58 are adapted to roll about vertical axis for engagement with the inner walls of opposed flanges 64. For that purpose a pair of rollers 58 is disposed adjacent the opposite edges of the door so that one of the pair engages one of the flanges and the other of the pair engages the other flange 64 of the guide tracks 16.

The guide rollers 58 are spaced from the central web 62 of the guide tracks 16 a sufficient amount so that the doors 16*a*, 16*b* and 16*c* can be placed on their respective tracks 26*a*, 26*b*, and 26*c* or 44 by moving a door upwardly in the space between the flanges 64 until they engage the rollers 58 with the central web 62. This allows sufficient space of the rollers 34 or 42 to clear their respective tracks 26*a*, 26*b*, and 26*c* or 44 by moving the bottom of the door laterally to align the rollers with the tracks. It is this vertical movement which causes aircraft hangar doors to be displaced by high winds during hurricanes and tornadoes or earthquakes. It is to this characteristic of rolling doors for aircraft hangars to which the invention is addressed.

The door retainer to which the invention is directed is designated generally at 70. The retainer 70 is disposed vertically in the upper door channel 20 of each of the doors and is in the form of a threaded bolt 72 passing through an opening 74 in a horizontal web portion 76 of the top door channel 20 of each of the doors, 16*a*, 16*b* and 16*c*. Because hangar doors typically are made of light materials, the web 76 is often best reinforced with washers 78 disposed at the underside and topside of the web 76. Similarly nuts 80 are threaded on the bolt 72 and tightened against each other to clamp the washers 78 and web 76 together and to firmly hold the bolt 72 in a vertical position. Adjustment of the retainer bolt 72 vertically to place its upper end 82 in closely spaced relation to the web 62 of the guide marks 60. Proper adjustment requires that the space designated at 86 in FIG. 9 be less than the depth of the guide rollers 34 or 42 at the bottom of the doors. The depth is the difference between the radius of the central portion 38 and checks 40 in the case of the roller 34 in FIG. 5 and the central portion 46 and checks or flanges 48 of the rollers 42 in FIG. 7.

The difference in the radius of the central track engaging portions 38 or 46 and the associated checks 40 or 48 represents the amount of vertical movement of the associated door required to remove the door from its track and also the amount of required movement of the upper guide rollers 58 in the channel shaped guide track 60. By adjusting the bolt 72 in close relation to web 62 thus vertical movement is limited to prevent removal manually or due to high winds or earthquakes. To remove the doors under normal conditions the retainer bolt 72 must be retracted a sufficient amount.

Installation of the retainer 70 preferably is at least two to each door closely adjacent to the opposite side edges of each door. If a single retainer is installed on each door, it should be disposed centrally between the side edges of the door.

Such installation of retainers 70 can be made easily with the doors in their usual vertical position on the tracks 16*a*, 16*b* and 16*c* by drilling a hole 74 to receive bolt 72 with the backing washers 78 and nuts 80 at opposite sides of the web as seen in FIG. 5. Tightening of the nuts toward each other grips the threaded bolt 72 and holds it firmly in position.

The installation of the retainer 70 and adjustment to their position to prevent displacement of the rollers from the associated tracks does not interfere with normal opening and closing of the doors 16*a*, 16*b* and 16*c*.

It should be noted that with stackable rolling doors such as those used with aircraft hangars, various prior art retainers cannot be used because they require the sides of the doors or the guide tracks to be accessible for installation.

A retainer for aircraft hangar rolling doors has been provided in which multiple doors at either side of a door opening are each provided with retainers that are adjustable between positions permitting movement of door rollers from being displaced laterally of their supporting tracks 26*a*, 26*b* and 26*c* a position preventing such movement to maintain the doors on their tracks. In the latter position the doors can operate manually between open and closed positions. The retainers are easily installed in new construction or on existing doors.

The invention claimed is:

1. A method of providing a retainer for an aircraft hangar door to limit vertical displacement of the hanger door, comprising:

a) providing an aircraft hanger having a lower supporting track positioned on one of a lower ground or a floor, an upper guide track and a hanger door, the upper guide track extending across a top and beyond opposite edges of an opening in the hanger, the hanger door having an upper channel member and a roller, the upper channel member having a web portion and a guide extending into the upper guide track and the roller including a grooved support roller that runs along the supporting track;

b) positioning a reinforcement apparatus on each of a topside and an underside of the web portion of the channel member, each reinforcement apparatus defining an aperture that extends through the apparatus, and then forming a hole in said upper channel member in axial alignment with the apertures of the reinforcement apparatus, c) inserting a threaded bolt through said apertures and hole, d) securing said bolt to said upper channel member so that said bolt is movable axially toward and away from said upper guide track; and e) axially moving the bolt so that an end of the bolt is positioned a distanced from the upper guide track that is less than a depth of the groove of the roller to limit upper movement of said hanger door and prevent said hanger door from being removed from said lower supporting track.

2. The method as defined in claim 1 and in which said upper guide track defines a channel having a central web and opposed depending flanges and including the step of:

adjusting said bolt to be positioned adjacent said central web.

3. The method as defined in claim 1 and including a lower frame member for receiving a lower edge of said hanger door to guide sliding movement of said hanger door on said lower supporting track, said hanger door being removable from said lower supporting track by vertical movement of said hanger door and said bolt limiting vertical movement of said hanger door to maintain said hanger door on said lower supporting track.

4. The method of claim 3, wherein said roller includes a roller having a v-groove that is mounted to said lower frame member and said lower supporting track comprises a ninety-degree angle iron track, said roller being moveably positioned on said lower supporting track and said v-groove of said roller being complementary to said angle of said lower supporting track.

5. The method of claim 1, wherein the hanger door comprises two door sections, each door section including a central door, an intermediate door positioned adjacent the central door, and an end door positioned adjacent the intermediate door.

6. The method of claim 1, wherein each said reinforcement apparatus comprises a washer.

7. The method of claim 1, where the guide extending into the upper guide track comprises a guide roller.

8. The method of claim 1, wherein the hanger door comprises two door sections.

9. The method of claim 1, wherein the bolt is secured to said upper channel member with a nut positioned on each of the topside and an underside of the web of the channel member.

* * * * *